US006595747B2

(12) United States Patent
Bos

(10) Patent No.: US 6,595,747 B2
(45) Date of Patent: Jul. 22, 2003

(54) GUIDE VANE STAGE OF A COMPRESSOR

(75) Inventor: Mathieu Bos, Zonhoven (BE)

(73) Assignee: Techspace Aero S.A. (BE)

( * ) Notice: Subject to any disclaimer, the term of this patent is extended or adjusted under 35 U.S.C. 154(b) by 0 days.

(21) Appl. No.: 10/000,830

(22) Filed: Nov. 30, 2001

(65) Prior Publication Data

US 2002/0085916 A1 Jul. 4, 2002

(30) Foreign Application Priority Data

Dec. 6, 2000 (EP) ..... 00870292

(51) Int. Cl.[7] ..... F01D 9/04
(52) U.S. Cl. ..... 415/209.4; 415/209.2
(58) Field of Search ..... 415/189, 190, 415/209.2, 209.3, 209.4, 210.1

(56) References Cited

U.S. PATENT DOCUMENTS

| | | | | | |
|---|---|---|---|---|---|
| 2,658,719 | A | * | 11/1953 | Johanson | 415/209.4 |
| 2,772,856 | A | * | 12/1956 | Kent et al. | 415/209.4 |
| 2,812,158 | A | | 11/1957 | Shinn | |
| 2,812,159 | A | | 11/1957 | Krebs | |
| 4,655,682 | A | * | 4/1987 | Kunz et al. | 415/209.4 |
| 5,062,767 | A | * | 11/1991 | Worley et al. | 415/209.3 |
| 5,399,069 | A | * | 3/1995 | Marey et al. | 415/209.3 |
| 5,569,019 | A | | 10/1996 | Katariya et al. | |
| 6,409,472 | B1 | * | 6/2002 | McMahon et al. | 415/189 |

FOREIGN PATENT DOCUMENTS

| | | | | |
|---|---|---|---|---|
| FR | 1252179 A1 | | 4/1961 | |
| GB | 732919 A | | 6/1955 | |
| GB | 2084261 A | * | 4/1982 | 415/189 |

OTHER PUBLICATIONS

European Search Report from Application No. EP 00870292 dated May 14, 2001.
English Translation of European Search Report from Application No. EP 00870292 dated May 14, 2001.

* cited by examiner

*Primary Examiner*—Christopher Verdier
(74) *Attorney, Agent, or Firm*—Knobbe Martens Olson & Bear LLP

(57) ABSTRACT

A guide vane stage of a compressor comprising an outer ring and an inner ring, both of which are concentric and preferably circular is provided. The rings are connected to each other via a series of fixed vanes, characterized in that at least one of the rings is provided with a series of holes or apertures which allow the vanes to pass through these holes or apertures. The fixed vanes also have, at at least one of their ends, an aperture to allow at least one locking element to pass through, making it possible to simultaneously securely fasten all the present in the guide vane stage, on the non-functional side of the ring. The end of the fixed vanes through which the locking element passes is buried in an elastomeric element.

9 Claims, 2 Drawing Sheets

GUIDE VANE STAGE OF A COMPRESSOR

CROSS-REFERENCE TO RELATED APPLICATIONS

This application claims priority to European Application No. 00 870 292.0, filed Dec. 6, 2000, the disclosure of which is herein incorporated by reference in its entirety.

BACKGROUND OF THE INVENTION

1. Field of the Invention

The present invention relates to a guide vane stage of a compressor, comprising a succession of guide vane or stator stages separated by rotor stages of rotating vanes, each guide vane stage consisting of fixed vanes connecting an inner ring to an outer ring.

2. Description of the Related Art

Coaxial compressors are well known per Se, and are used in several types of applications. In particular, they are used in twin-structure engines, turbofan engines and turbojet engines. It is also noted that they are present in power stations. These low-pressure or high-pressure compressors substantially consist of several rotating vane stages or rotor stages separated by stator stages or guide vane stages whose function is to reposition (rectify) the speed vector of the fluid exiting the previous stage before sending it to the next compartment.

Each of these guide vane stages consists essentially of fixed vanes connecting an outer ring to an inner ring, both of which are concentric.

A major problem in the case of the guide vane stages of a compressor is that said vanes should be securely fastened to the rings in a particularly efficient manner. Specifically, this fastening of the vanes to the rings must be optimal so as to be able to withstand accidents such as the breaking of a vane or the ingestion of a foreign body such as a bird into said turbojet engine.

Usually, the vanes are fastened to the rings, both the inner and outer rings, by means of rivets, bolts or welds. Nevertheless, the use of these means of fastening has the major drawback of disrupting the flow and of generating a loss of pressure in the aerodynamic stream.

U.S. Pat. No. 2,812,159 discloses a device for assembling vanes comprising a series of U-shaped components, each of said vanes being provided with a hole at the bottom of the "U" which fits the free end of said vanes, said assembling being secured by means of fastening means comprising among other things screws and which are adapted so as to prevent lateral and axial movements of the vanes. However, disruption of the aerodynamic flow stream is encountered when screws or similar fastening means are used.

It has also been proposed in British Patent No. A-732 919 to use a device for assembling the vanes, wherein the vanes are assembled together by means of a sheet metal skin through the vanes and used as a supporting structure passing and by means of a flange. Moreover, end portions of the vanes are drilled to provide holes through which a locking wire extends circumferentially of the assembly, so that the vanes are retained in position. A tack-weld may be provided between the flange and the vanes so as to ensure an additional retention of the vanes. The problem of the disruption of the aerodynamic flow stream is therefore still existing.

French Patent No. A-1 252 179 is related to an assembly of fixed vanes on rings, wherein said fixed vanes are transiently linked together by their T-shaped feet by means of a strip which fits to the top of said feet. However, even if it is not necessary to remove thereafter said strip, said assembly still uses screws to fasten the vanes to the rings, with thus has the same drawbacks as the one mentioned hereabove.

U.S. Patent No. 5,569,019 discloses a fan stator assembly comprising inner and outer shrouds provided with openings through which vanes pass, said vanes being radially restrained to the inner and outer shrouds by means of seals. Each vane substantially consists of two parts, an airfoil section and a foot. The vanes preferably comprise a non-metallic composite material consisting of a plurality of compression molded, heat cured plies, including plies of para-aramid fibers which are continuous throughout the airfoil section and the foot of the vanes but are discontinuous (cut) at the junction of the airfoil section with the foot.

U.S. Patent No. 2,812,158 discloses a stator ring assembly for a turbocompressor, comprising an outer ring, an inner ring and rows of stator vanes, wherein the outer end of each vane is received in an opening in the outer ring and projects beyond said outer ring. In said assembly, two rows of vanes are held in position by means of a circumferentially stressed band surrounding and separate from the outer ring and engaging with the outer end surfaces of the vanes.

SUMMARY OF THE INVENTION

The present invention aims to propose a solution for simplifying the assembly of vanes fixed both to the inner ring and to the outer ring.

In particular, the present invention aims to provide a solution which offers great simplicity of assembly and which requires no additional assembly operations.

The present invention aims also to propose a solution which allows the aerodynamic flow stream not to be affected by the presence of welds or rivets on the ring.

The present invention aims also to provide an inexpensive solution.

The present invention relates to a guide vane stage of a compressor comprising two rings, an inner ring and an outer ring, both of which are concentric and preferably circular and connected to each other via a series of fixed vanes. At least one of the rings, and preferably both the inner and outer ring, are provided with holes which allow said vanes to pass through these holes to allow them to be fastened to the rings. With this aim, the vanes also have, at at least one end and preferably at both of their ends, an aperture to allow a locking element to pass through. This locking element will advantageously make it possible to securely fasten the vanes to at least one and preferably to both the rings on the non-functional side, that is to say on the side of the inner face for the inner ring and on the side of the outer face for the outer ring.

According to the present invention, the vanes are securely fastened to the ring or rings by passing a tape in one or more pieces, which successively passes through all the apertures of the vanes on the same guide vane stage, on the non-functional side of the rings.

Advantageously, this tape has an elastic function and will be buried in an elastomeric element which allows the various components, and in particular the locking elements, to be protected.

DETAILED DESCRIPTION OF THE PREFERRED EMBODIMENT

Figure 1:
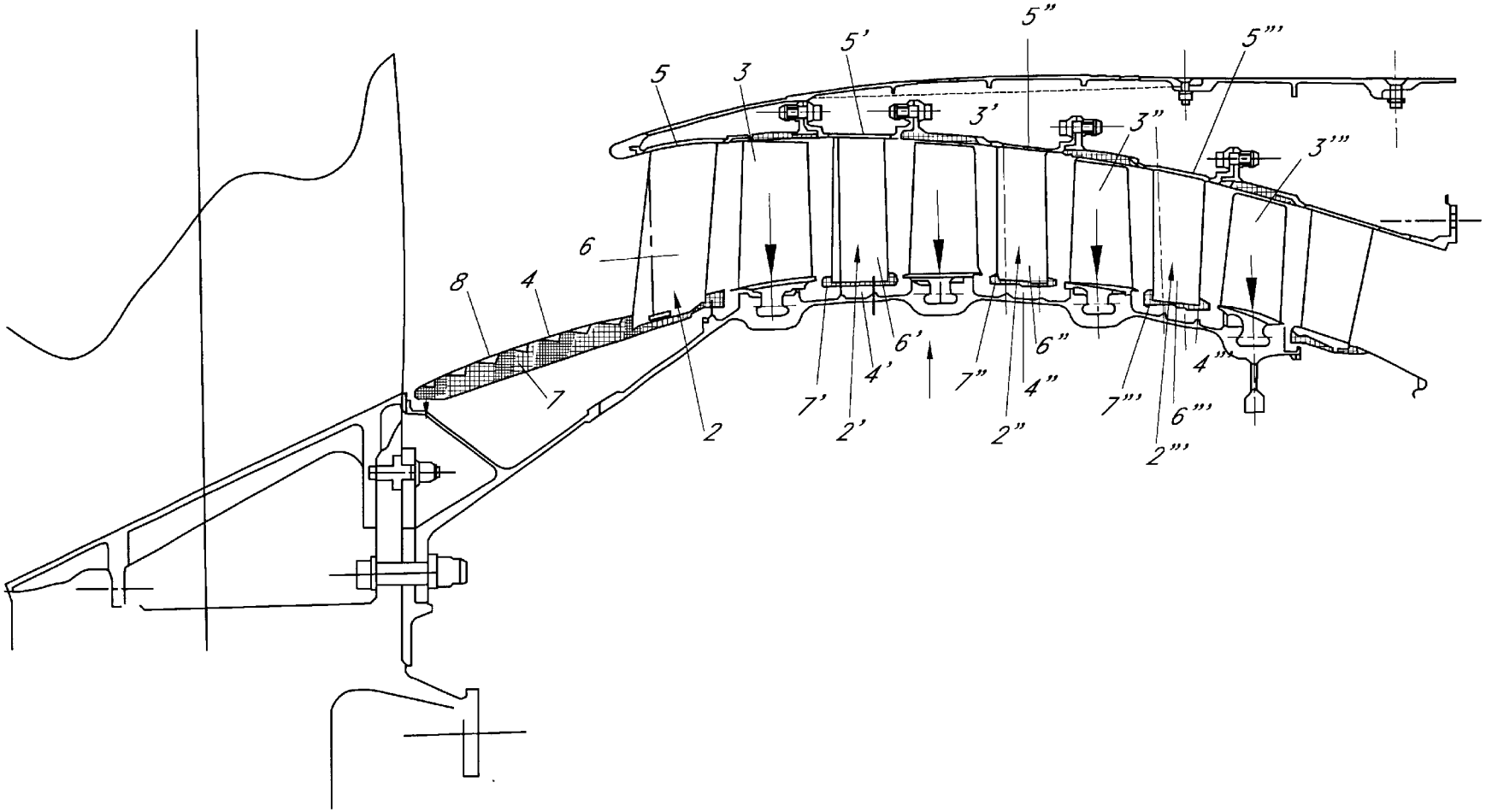
FIG. 1 represents a general view of the compression stage of a turbofan engine.
Figure 2:
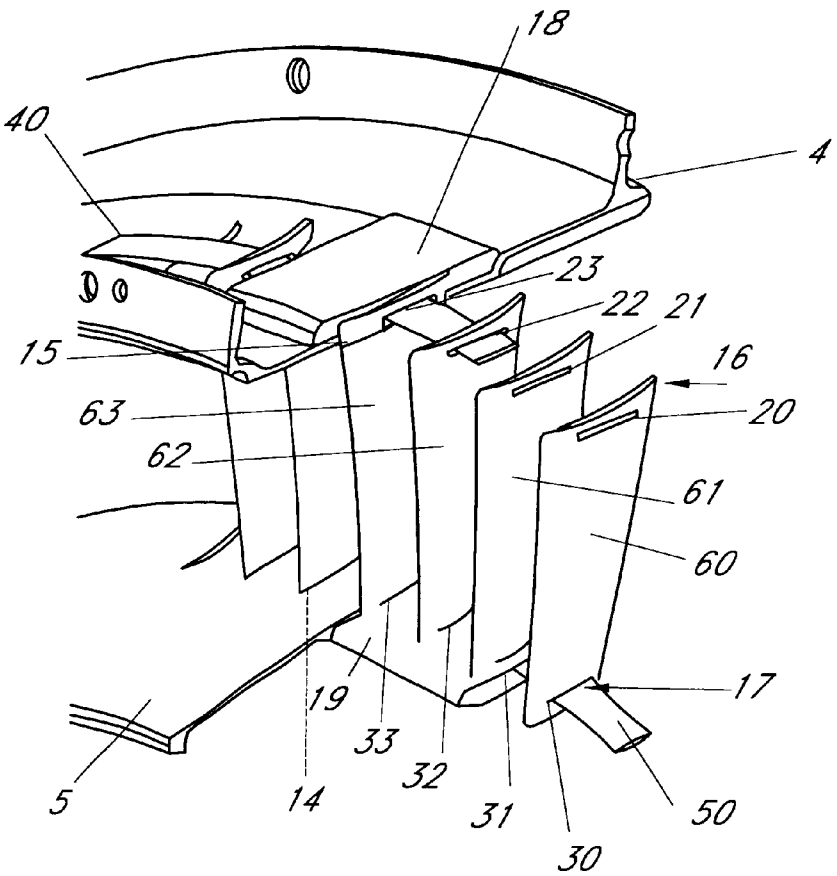
FIG. 2 represents the solution used in the present invention to securely fasten fixed vanes to both the outer and inner rings.

The solution proposed by the present invention for securely fastening the fixed vanes 6 to the rings 4 and 5 for a guide vane stage 2 is described in FIG. 2. Needless to say, the same solution might be adapted to each guide vane stage 2', 2", etc. Each ring, both the inner ring 4 and the outer ring 5, is provided with a series of holes or apertures (series 14 and 15, respectively) which allow the fixed vanes 60, 61, 62, 63, etc. to pass via one of their ends to the corresponding ring.

The result of this is that once the fixed vanes 60, 61, 62, 63, etc. are fixed to said rings, a portion 16 and 17 of said fixed vanes 60, 61, 62, 63, etc. protrudes from the rings 4 and 5. The various portions 16 or 17 themselves each also have an aperture 20, 21, 22, 23, etc. and 30, 31, 32, etc. which allows a locking element (40 and 50, respectively) to be introduced. In this instance, said locking element takes the form of a tape which, by simultaneously, passing through either all the apertures 20, 21, 22, etc., or all the apertures 30, 31, 32, etc. of the fixed vanes 60, 61, 62, 63, etc., securely fastens said fixed vanes to the inner ring 4 and outer ring 5. This takes place on the non-functional face of said ring, that is to say on the inner face of the inner ring 4 and on the outer face of the outer ring 5.

Preferably, this tape has an elastic function and is in a single piece. According to another embodiment, the tape may comprise several pieces.

It should be noted that, in the case represented in FIG. 2, the fixed vanes are securely fastened to the two rings in this manner, on the one hand to the inner ring 4, and on the other hand to the outer ring 5, by means of two locking elements 40 and 50. Another possibility is that the fixed vanes are securely fastened in this way to only one of the two rings.

Preferably, the ends 16 or 17 of the fixed vanes 60, 61, 62, 63, etc. through which the locking element 40 or 50 passes are buried in an elastomeric element 18 or 19.

Such a device for secure fastening has several advantages. Firstly, it does not cause any defect in the aerodynamic flow stream, thus greatly reducing the pressure losses therein.

It is simple to produce and easy to mount and to dismantle. In addition, it ensures an optimum use of the material. Another advantage is that it makes it possible to assemble and securely fasten two types of components, the fixed vanes and the ring, without mechanical connection, and without changing the functional appearance of these two types of components.

What is claimed is:

1. A guide vane stage of a compressor comprising:

an outer ring;

an inner ring concentric with said outer ring;

a plurality of fixed vanes connecting said outer ring and said inner ring, each of said vanes comprising at at least one of their ends an aperture, wherein at least one of the inner and outer rings has a series of apertures which allow said vanes to pass through said apertures; and a locking element for simultaneously securely fastening said vanes on the non-functional side of said at least one ring comprising said series of apertures by passing through said apertures in said vanes, wherein said locking element comprises a tape which passes successively through said apertures of said vanes, said tape having an elastic function.

2. The guide vane stage of claim 1 further comprising an elastic element, wherein the end of the vane through which said locking element passes is buried in said elastic element.

3. The guide vane stage of claim 1, wherein said rings are circular.

4. The guide vane stage of claim 1, wherein said tape comprises one or more pieces.

5. The guide vane stage of claim 1, wherein said inner ring has said series of apertures which allow said vanes to pass through said apertures.

6. The guide vane stage of claim 1 wherein said outer ring has said series of apertures which allow said vanes to pass through said apertures.

7. The guide vane stage of claim 1, wherein both said inner ring and said outer ring have said series of apertures which allow said vanes to pass through said apertures.

8. The guide vane stage of claim 1, wherein said tape comprises one piece.

9. The guide vane stage of claim 1, wherein said locking element is not secured with bolts, rivets, or welds.

* * * * *

UNITED STATES PATENT AND TRADEMARK OFFICE

CERTIFICATE OF CORRECTION

PATENT NO. : 6,595,747 B2
DATED : July 22, 2003
INVENTOR(S) : Mathieu Bos

It is certified that error appears in the above-identified patent and that said Letters Patent is hereby corrected as shown below:

Column 4,
Line 13, please replace “comprising at at least” with -- comprising at least” --.

Signed and Sealed this

Eleventh Day of November, 2003

JAMES E. ROGAN
*Director of the United States Patent and Trademark Office*